US005269082A

United States Patent [19]

Sund et al.

[11] Patent Number: 5,269,082

[45] Date of Patent: * Dec. 14, 1993

[54] ROTARY SWEEPER ATTACHMENT

[75] Inventors: Lloyd P. Sund, Newburg; Paul G. Sund, Upham; Ronald E. Bergman, Bottineau, all of N. Dak.

[73] Assignee: Powrebroom, Inc., Upham, N. Dak.

[ * ] Notice: The portion of the term of this patent subsequent to Nov. 10, 2009 has been disclaimed.

[21] Appl. No.: 882,118

[22] Filed: May 13, 1992

Related U.S. Application Data

[63] Continuation-in-part of Ser. No. 729,063, Jul. 12, 1991.

[51] Int. Cl.[5] ..... E01H 5/09

[52] U.S. Cl. ..... 37/259; 37/246; 37/285

[58] Field of Search ..... 37/285, 244, 259, 246, 37/233, 223

[56] References Cited

U.S. PATENT DOCUMENTS

| | | | |
|---|---|---|---|
| 1,439,832 | 12/1922 | Merril . | |
| 2,132,456 | 10/1938 | Gast . | |
| 2,148,841 | 2/1939 | Senior . | |
| 2,171,075 | 8/1939 | Blazier | 37/285 X |
| 2,633,789 | 4/1953 | Ober . | |
| 2,974,471 | 3/1961 | Murphy . | |
| 3,045,267 | 7/1962 | Wagner . | |
| 3,106,733 | 10/1963 | Le Counte et al. . | |
| 3,340,626 | 9/1967 | Konucik . | |
| 3,603,162 | 9/1971 | Gohler . | |
| 3,758,967 | 9/1973 | Thompson . | |
| 3,783,592 | 1/1974 | Schraut . | |
| 4,064,679 | 12/1977 | Spinner . | |
| 4,190,972 | 3/1980 | Berner | 37/285 X |
| 4,255,880 | 3/1981 | McMickle et al. | 37/285 X |
| 4,295,285 | 10/1981 | Stevens | 37/246 |
| 4,329,792 | 5/1982 | Berner | 37/246 |
| 4,602,400 | 7/1986 | Agergard et al. . | |
| 4,893,368 | 1/1990 | Ward . | |
| 4,897,942 | 2/1990 | Klas et al. | 37/244 |
| 4,920,667 | 5/1990 | Dixon | 37/285 |

OTHER PUBLICATIONS

One page brochure published by Stihl, Inc.
Multiple page catalog published by Stihl, Inc.
Parts List published by Stihl, Inc. for Stihl Cultivator BC 40.

*Primary Examiner*—Randolph A. Reese
*Assistant Examiner*—J. Russell McBee
*Attorney, Agent, or Firm*—Moore & Hansen

[57] ABSTRACT

The present invention provides a hand held, readily portable power sweeping tool. The tool includes an elongate boom having a power generation means disposed at one end thereof and a power sweeping means disposed at the other end. Power transmission means extends between the power generation means and the power sweeping means for transmitting power generated by the power generation means to the sweeping means. The sweeping means comprises a pair of drums mounted for rotation by the power transmission means, the drums including a plurality of pliant fins extending radially outwardly therefrom. In one embodiment of the invention, the sweeping means includes a support formed by mating two substantially identical drum members to each other end-to-end to form a support for a sweeper belt having a plurality of outwardly directed pliant fins.

22 Claims, 5 Drawing Sheets

ROTARY SWEEPER ATTACHMENT

This application is a continuation-in-part of U.S. patent application Ser. No. 07/729,063 filed Jul. 12, 1991.

The present invention relates in general to power sweeping tools and in particular to a light-weight, hand-held powered tool for removing snow and debris from sidewalks, driveways, decks, roofs, lawns or other surfaces.

BACKGROUND OF THE PRESENT INVENTION

Traditionally, snow removal equipment has included wheeled vehicles either pushed or self-propelled that throw snow in a desired direction, generally transverse to the direction of travel. This equipment is often quite heavy and is therefore generally quite cumbersome to use since it is not easily maneuverable and particularly so when the snowfall is minimal. The utility of this equipment is also limited generally to snow removal only and does not include general debris removal.

Powered sweepers, such as that disclosed in U.S. Pat. No. 4,602,400 to Agergard et al., are also known in the art. Generally they comprise a wheeled vehicle having a cylindrical brush rotatably driven by a gas engine. These devices can also be cumbersome to use and are not preferred for snow removal. Such sweepers, like snow blowers, can be difficult for the elderly to use because of their size and can be difficult to move onto a deck for snow or other debris removal. Additionally, sometimes snow and debris removal from roofs, particularly flat roofs, is necessary. Moving such conventional snow or debris removal equipment to a roof is generally impractical for most individuals, assuming the roof could support the weight of such equipment.

Equipment utilizing pressurized air to move debris is known in the art. Typically these are hand-carried devices that shoot a pressurized stream of air in a generally desired direction. These devices are used to blow leaves in lieu of raking and to clear walks and drives. They could be useful for some snow removal, but not when the snow is wet and heavy since the flakes adhere to each other and the pressurized airstream is insufficient to move it. Thus, the usefulness of this tool is also limited.

It would be desirable to have snow removable equipment that was light enough to be hand held, that was readily portable and that was capable of handling snow falls—wet or dry—of up to several inches in depth. It would further be desirable if such equipment were operable to remove general debris, such as sand, small rocks and leaves or other like debris from walkways, driveways, roofs, decks or other surfaces.

SUMMARY OF THE PRESENT INVENTION

The present invention provides a readily portable hand held power sweeping tool useful for removal of snow and debris such as leaves, sand, dirt, small rocks and the like from sidewalks, driveways, decks, roofs or similar surfaces, as well as from lawns without damage to the grass. The tool has an elongate boom having a power generation means disposed at one end thereof and a sweeping means at the other end. Power transmission means extend between the power generation means and the sweeping means to provide power to the sweeping means. The power transmission means includes a pair of stub drive shafts extending transversely to and outwardly from the boom in opposite directions. The sweeping means comprises a pair of sweepers, one attached to each drive shaft. Each sweeper includes a cylindrical support means having an attachment means for affixing the support means to a drive shaft so that the sweeper rotates synchronously therewith. Each sweeper further includes a belt means having substantially outwardly extending pliant sweeping fins. The belt means may be a one piece article whose free ends are attached together around the support means to form the cylindrical sweeper or may include a plurality of smaller belt sections whose free ends are attached together to form a single belt.

Operationally, each sweeper is rotated by the power generator means and operates to push against and move material such as snow and debris that has collected on a surface whose cleaning is desired from that surface to another location.

In one embodiment of the invention, the sweeper means attachment may include a support means formed from mated first and second substantially identical drum members. Each of the drum members is defined by at least one side wall, an end of the side wall including at least two flanges that extend alternately from the inner or outer side of the side wall and substantially parallel thereto. When the first and second members are joined, the flanges overlap in face-to-face engagement with each other. An axle extends between substantially closed ends of the mated drums, with one end of the axle including means for attaching the support means to a stub drive shaft.

The foregoing objects of the invention will become apparent to those skilled in the art when the following detailed description of the invention is read in conjunction with the accompanying drawings and claims. Throughout the drawings, like numerals refer to similar or identical parts.

DETAILED DESCRIPTION OF THE PRESENT INVENTION

Figure 1:
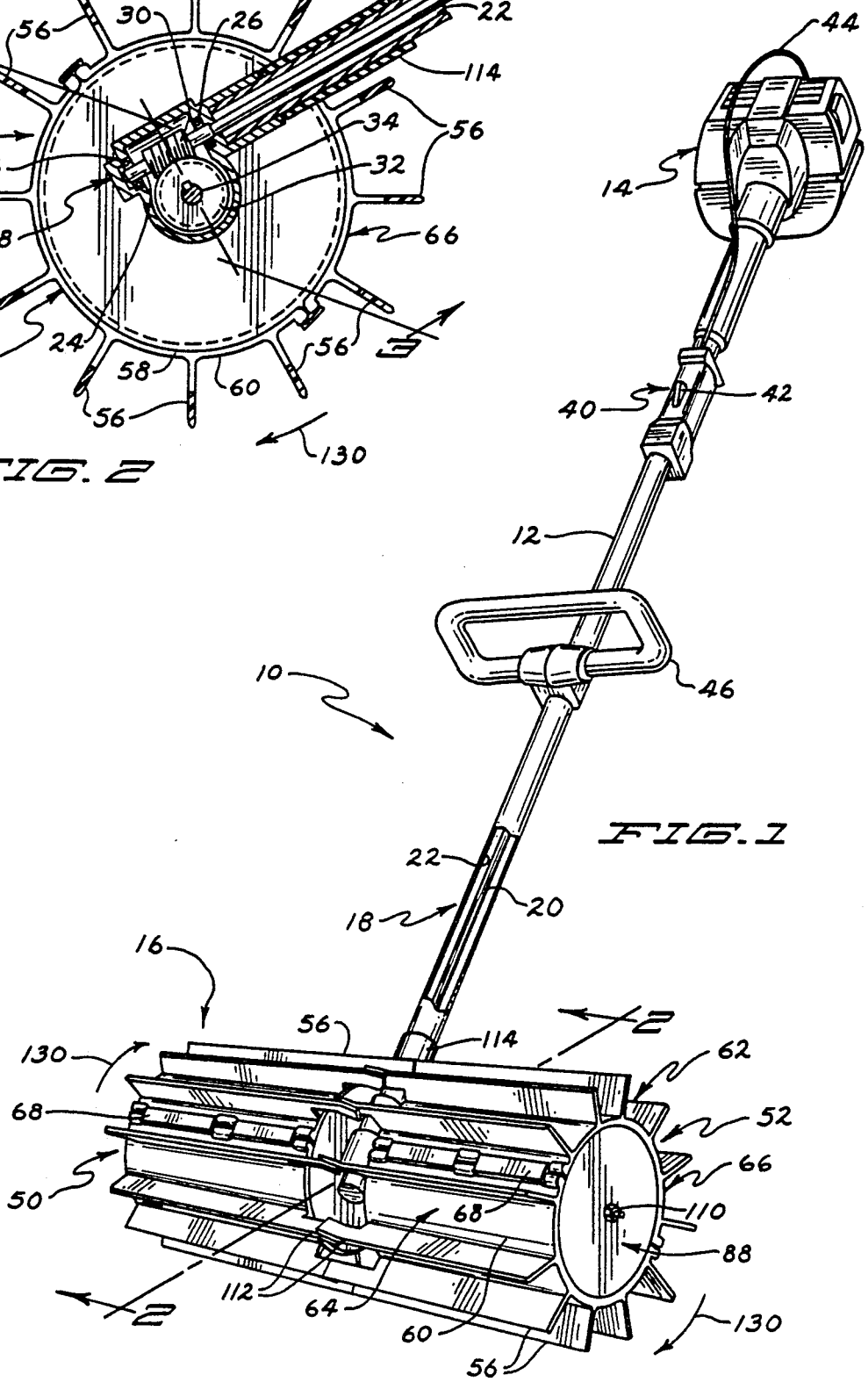
FIG. 1 is a perspective view of an embodiment of a power sweeping tool as described and claimed herein.

FIG. 1 shows a hand held power sweeping tool 10 in accordance with the present invention. Tool 10 includes an elongate boom 12 having a power generation means 14 attached at one end thereof and a power sweeping means 16 disposed at the other end thereof. Power generation means 14 may be a gas or electric motor as known in the art. Boom 12 further includes a power transmission means 18 for transmitting power generated by means 14 to sweeping means 16. Power transmission means 18 includes a rotatable shaft 20 contained internally of boom 12 in a sleeve 22.

Figure 2:
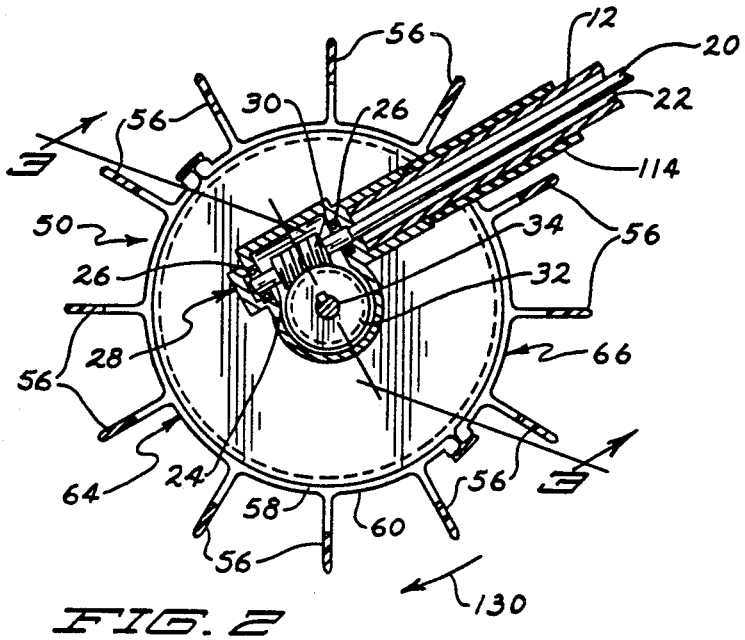
FIG. 2 is a cross sectional view of a portion of the power transmission means and power sweeping tool of FIG. 1 taken along cutting plane 2—2.
Figure 3:
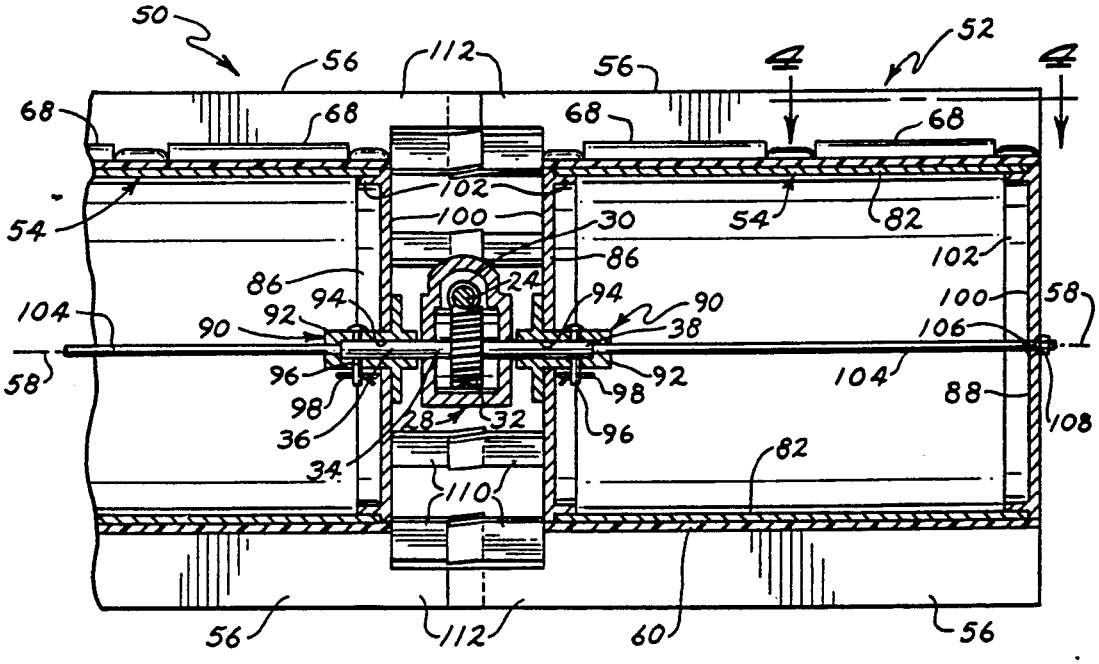
FIG. 3 is a cross sectional view of the power transmission means and a partial view of the power sweeping means taken along cutting plane 3—3 of FIG. 2.

Referring now to FIGS. 2 and 3 particularly, a first end of shaft 20 is rotatably engaged (not shown) by power generation means 14 in a known manner. The other end 24 of shaft 20 is mounted by appropriate bearings 26 contained within a differential 28. Shaft end 24 includes a worm 30 that engages a worm gear 32. Worm gear 32 is attached to a drive shaft 34 having shaft ends 36 and 38 that extend laterally outwardly of differential 28. Shaft ends 36 and 38 of drive shaft 34 function as stub drive shafts as will be clear from the following descriptions. Thus, together worm 30 and worm gear 32 change the direction of power transmission from a direction parallel to boom 12 to a direction 90° therefrom. Power transmission means 18 may further include a throttle means 40 having a trigger means (not shown) to control the power output of power generation means 14 and a thumb or hand actuated safety engagement switch 42. The trigger means communicates by a throttle wire 44 with power generation means 14 where power generation means 14 is a gas powered engine. Where means 14 is an electric motor, the trigger means will act as a rheostat and wire 44 will carry an electrical signal. For convenience, a handle 46 may be attached to boom 12 with tool 10 to facilitate carrying and movement of the tool as desired.

Referring now FIGS. 1-3 in particular, power sweeping means 16 comprises a pair of sweepers 50 and 52 attached to shaft ends 36 and 38 of drive shaft 34 respectively. Each sweeper is substantially identical to the other. Thus, it will be understood that a description of sweeper 52 will also describe sweeper 50. Thus, sweeper 52 includes a cylindrical support means 54 supporting a plurality of sweeper fins 56. Fins 56 project substantially radially outwardly from cylindrical support means 54. As shown, fins 56 are disposed at substantially 90° angles to boom 12 and parallel to the longitudinal axis 58 of the sweeper means 16, which is coincident with the axis of drive shaft 34. Sweeper fins 56 may be disposed at a slight angle to axis 58 if desired.

Figure 4:
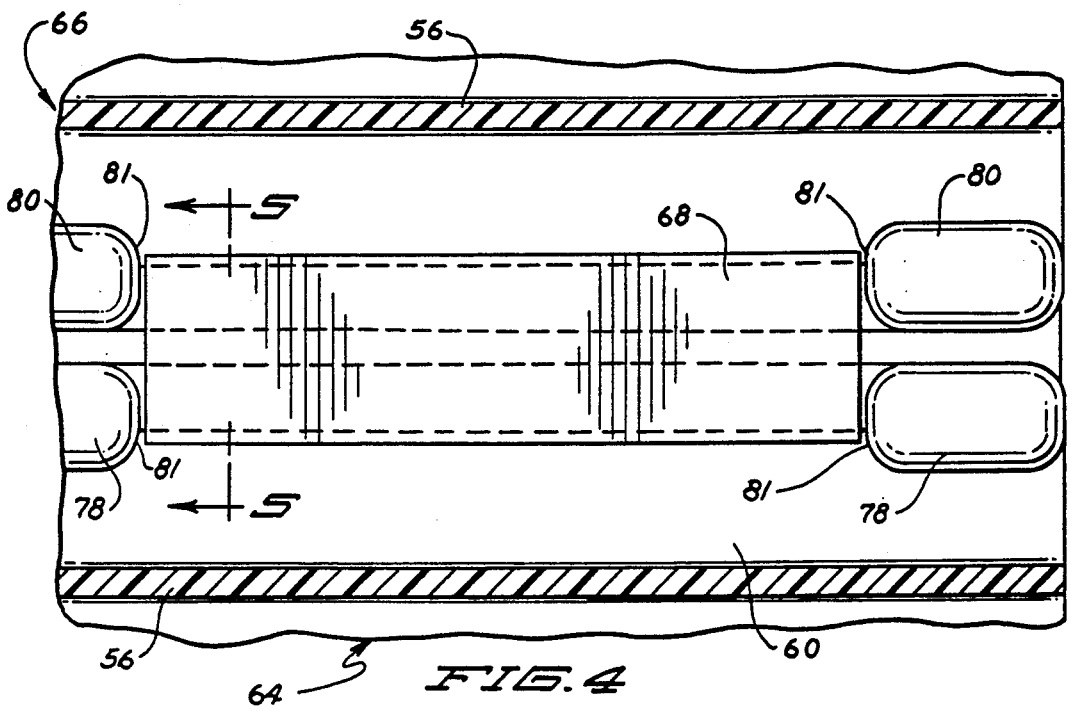
FIG. 4 is a top plan view partially in cross section showing a means for attaching a pair of adjacent free belt ends to each other.
Figure 5:
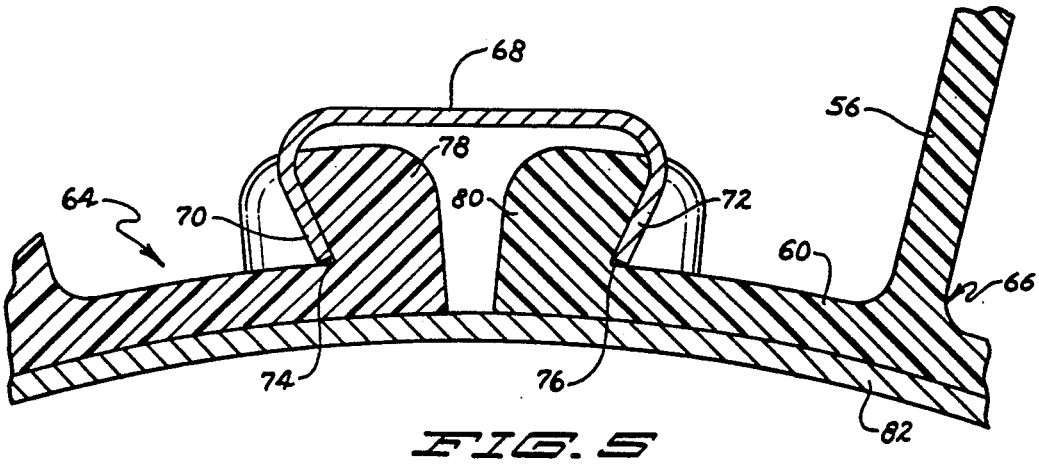
FIG. 5 is a cross section view of the belt end attachment shown in FIG. 4 taken along cutting plane 5—5 thereof.

In the embodiment shown, sweeper fins 56 are attached to a belt carcass 60, together forming a belt 62. As shown in the Figures, belt 62 is comprised of a plurality of individual belt sections 64 and 66 that are attached at their adjacent ends to form a single continuous belt. Belt section 64 and 66 are attached at their adjacent free ends by a C-clip 68 whose free ends 70 and 72 engage recessed slots 74 and 76, respectively, in outward belt projections 78 and 80 disposed along the edges of belt sections 64 and 66, respectively, all as best seen in FIGS. 4 and 5. The C-clip 68 is restrained from longitudinal movement by projection ends 81, best seen in FIG. 4. C-clip 68 is crimped such that ends 70 and 72 are pulled together, thereby pulling the free ends of the belt sections together. Thus, as the ends of the belt sections are attached to one another, the belt is tightened around cylindrical support means 54 so as to achieve a friction fit thereon and to rotate with means 54.

In the embodiment shown in FIGS. 1-5, cylindrical support means 54 of sweeper 52 comprises a cylinder or drum 82 whose open ends 84 are closed by affixed end caps 86 and 88. Inner end cap 86 includes a centrally disposed shaft receiving means 90. Means 90 includes a hub 92 having a central bore 94 for receiving shaft end 38. Preferably, both hub 92 and its received shaft end 38 include mutually alignable through holes for receiving a retaining pin 96 to rigidly attach sweeper 52 to shaft end 3 for rotation therewith. Pin 96 is retained by means of a key 98 insertable through a through hole in the end thereof in a known manner.

As noted, sweeper 50 is substantially similar to sweeper 52 and the description just provided of the cylindrical support means 54 and its attachment to shaft end 38 is descriptive of the cylindrical support means 54 of sweeper 50 and its attachment to shaft end 36. Sweeper means 50 and 52 are interchangeable and thus the aforesaid attachment descriptions also suffice to describe a reversed attachment wherein sweeper 50 is attached to shaft end 38 and sweeper 52 is attached to shaft end 36.

Figure 6:
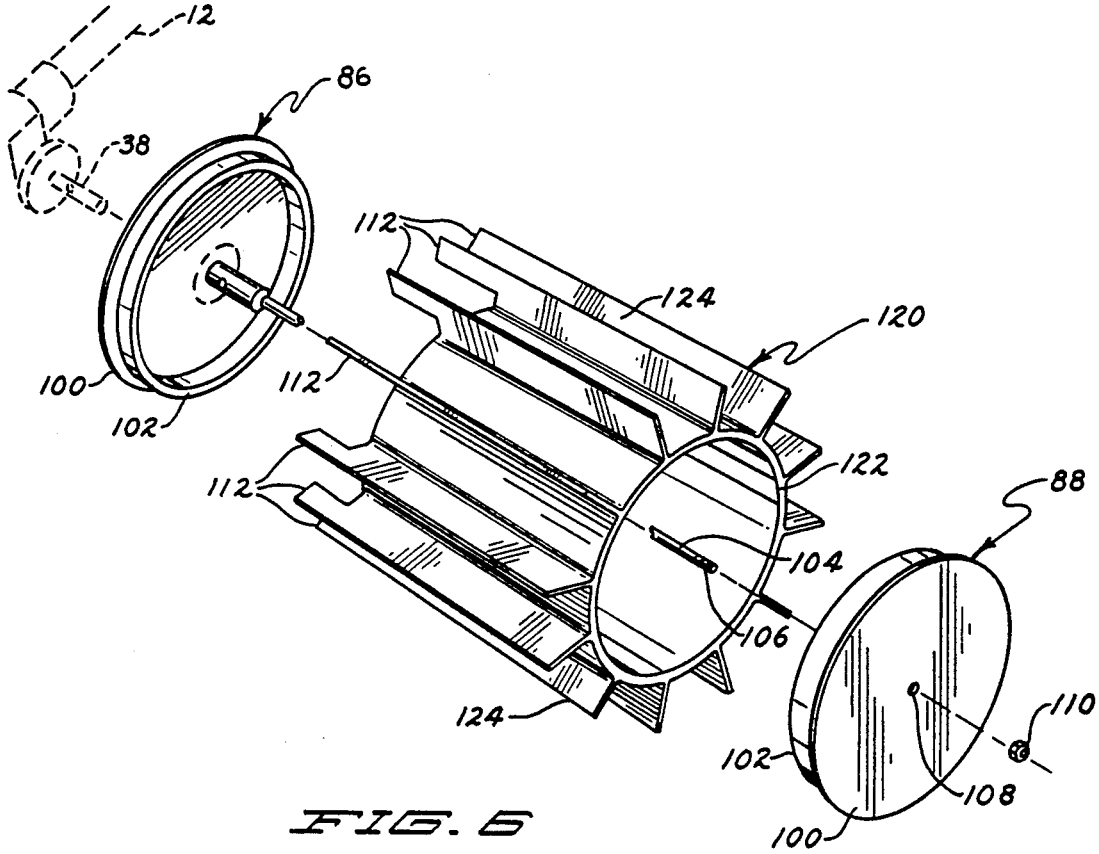
FIG. 6 shows an alternate embodiment of the sweeping means.

The configuration of end caps 86 and 88 is best seen in FIG. 6. Each end cap includes a disk-shaped portion 100 to which an annular rim 102 is attached. In the embodiment shown in FIG. 3, annular rim 102 has an outer diameter substantially equal to the inner diameter of cylinder 82 so as to be snugly received thereby in a friction fit. Annular rim 102 further aids cylinder 82 in maintaining its cylindrical shape during operation by outwardly supporting the wall of cylinder 82. A support rod 104 extends along longitudinal axis 58 of cylindrical support means 54 between shaft receiving means 92 and disk 100 of end cap 88. Rod 104 has a threaded outer end 106 that extends through a centrally located opening 108 of end cap 88 and receives a threaded fastener 110 to rigidly attach end caps 86 and 88 together.

In the embodiment seen in FIGS. 1-5, fins 56 on sweepers 50 and 52 include inwardly extending fin segments 112 that extend inwardly towards boom 12 in overlapping engagement with each other. In FIG. 2, the fin segments 112 of sweeper 52 have been eliminated for clarity of illustration. Preferably, the fin extensions 112 have a length substantially equal to or greater than the distance between the inner end cap 86 of its respective cylindrical support means and the center of boom 12. A pair of adjacent fins thus extends substantially across the gap between support means 54 of sweepers 50 and 52. Fin extensions 112 of sweeper 50 and sweeper 52 are shown physically engaged with each other in FIGS. 1 and 3 and such engagement is generally preferred, though the fins 56 of sweepers 50 and 52 may be offset so as to not form a substantially straight line and such an embodiment is within the purview of the present invention. As best seen in FIGS. 1 and 3, fin extensions 112 provide the ability to sweep a substantially complete, continuous swath equal to the width of sweeping means 16.

Fin extensions 112 are formed of a flexible material as are the rest of fins 56, and, because of their length, they will strike boom 12 during rotation. To prevent excessive wear to boom 12 and/or to fin extensions 112, boom 12 may include a wear collar 114 made of hard rubber, plastic or any wear-resistant material Wear collar 114 has a substantially cylindrical configuration as shown to conform to the configuration of boom 12 and to surround boom 12 where contact between the boom and the fin segments 112 would occur. Collar 114 may have other configurations but preferably has a smoothly contoured outer surface to reduce wear to fin segments 112. Collar 114 may fit loosely about boom 12 or may be affixed thereto by known means such as gluing, bolting, or welding, dependent upon the type of material used for collar 114.

Without fin extensions 112, an unswept swath equal to the distance between inner end caps 86 of sweepers 50 and 52 would be left during a sweeping operation. That is, with the present invention, an operator is able to sweep an uninterrupted swath substantially equal to the width of sweeping means 16. A tool 10 having no fin segments 112 or fin segments having a length less than the distance between the center of boom 12 and the inner end cap 86 is also within the purview of the present invention.

An alternative embodiment to the present invention is shown in FIG. 6 wherein a unitary belt 120 comprises a belt carcass 122 from which a plurality of flexible fins 124 extend. Belt carcass 122 is made of a sufficiently stiff material that cylinder 82 is not required in order to maintain the cylindrical configuration of the belt. In this embodiment then, end caps 86 and 88 serve as cylindrical support means. Belt carcass 122 may be frictionally engaged on annular disk portions 102 such that it will rotate with stub drive shafts 36 and 38 or mounted thereto using other means known in the art.

The present invention as described provides a general purpose, readily portable, hand held sweeping tool. It is useful for sweeping small rocks, wood chips, leaves, snow, cans and bottles, from driveways, sidewalks, decks, roofs, lawns or other surfaces, including interior floors where debris may be found. As seen in FIGS. 1 and 2, when held in the operating position shown in FIG. 1, sweeper means 16 generally rotates in a clockwise fashion as indicated by arrow 130. This direction of operation is useful when it is desired to push debris ahead of the operator. However, due to the portable, hand held nature of tool 10, the tool may be inverted such that sweeping means 16 is rotating in a counterclockwise direction. In such a mode of operation, handle 46 would be disposed underneath boom 12 rather than above it as shown in FIG. 1. When so held, tool 10 is useful for pulling debris away from structures or fences; it may then be inverted to the operating position shown in FIG. 1 to sweep debris ahead of the operator. The flexible fins used on tool 10 are not harmful to the surfaces they contact, particularly grass. This makes tool 10 useful for sweeping debris that may have fallen upon a lawn, such as leaves or trash. A further advantage of tool 10 is that it is easily portable. Thus, it is readily moved onto a deck or carried onto a roof when needed to remove snow or other debris therefrom. Tool 10 has the further advantage that once it has been lifted, no further lifting effort is required. Thus, unlike snow removal by hand where a shovel is used, tool 10 may be carried in a single position and the snow removed from a surface by pushing it ahead of the operator as he moves forward.

Figure 9:
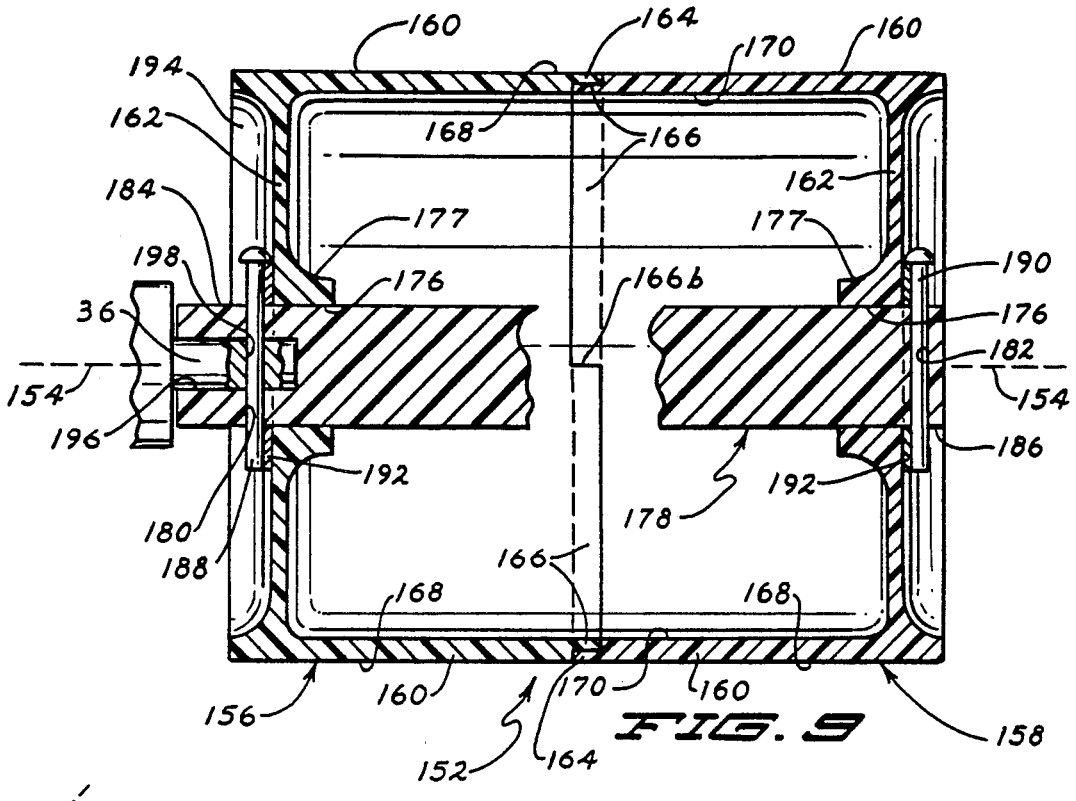
FIG. 9 shows a cross sectional view taken along cutting plane 9—9 of FIG. 8 of the support means shown in FIGS. 7 and 8 and in particular shows the axle in partial view and the axle bore that receives a stub drive shaft.
Figure 10:
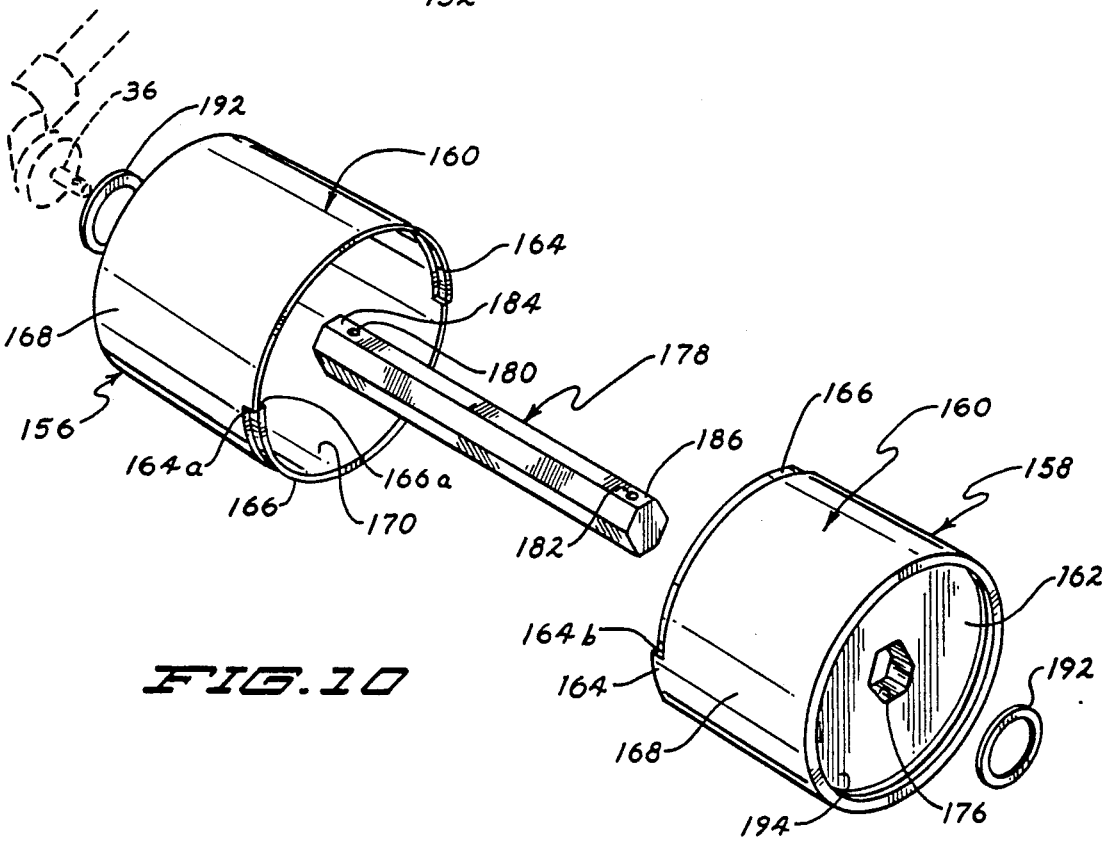
FIG. 10 shows an exploded perspective view of the support means shown in FIGS. 7–9.

FIGS. 7–10 show another embodiment 150 of a sweeper attachment useful with the present invention. Sweeper attachment 150 includes a support means 152 having a longitudinal axis 154 about which support means 152 is substantially symmetric. Support means 152 supports a plurality of substantially radially directed sweeper fins, such as fins 56, shown in phantom in FIG. 8, and includes first and second open ended drums 156 and 158, respectively (FIG. 10). Drums 156 and 158 are substantially identical to each other. Thus, a description of one will suffice as a description of the other. By making first and second drums 156 and 158 substantially identical to each other, the support means 152 may be manufactured of a moldable material using a single mold to produce the drums, two of which are then joined together to form the support means 152.

Each drum 156 and 158 includes at least one side wall 160 and an end wall 162 substantially closing one end of the drum. Side wall 160 is substantially parallel to longitudinal axis 154. Each drum 156, 158 includes at least first and second flanges 164 and 166 extending axially from the other, open end of the drum (FIGS. 9, 10). Flanges 164 and 166 comprise a means for matingly engaging drums 156 and 158 to form support means 152. Flange 164 extends from the outer side 168 of side wall 160 and has a width approximately one-half the width of the side wall 160. Flange 166 extends from the inner side 170 of side wall 160 and also has a width approximately one-half the width of side wall 160. As shown, the flanges 164 and 166 have a substantially uniform width along their length. If desired, however, the flanges may have a thicker base than free end, that is, they may have a taper. Or, to provide an interlock between drums 156 and 158, the flanges 164 and 166 may have a slightly thinner base than free end.

The embodiment of drums 156 and 158 shown has two flanges, though more than two may be used. Thus, drums 156 and 158 could have four, six, eight, etc. flanges extending alternately from the inner and outer surfaces of the drums. Additionally, while the embodiment shown has two flanges of substantially equal length, that is, flanges 164 and flange 166 each extend substantially half way around the exterior of side wall 160, differing arc lengths for the flanges may be used when more than two flanges are used. For example, when four flanges are used, two of the flanges could each extend for three-eighths of the distance around the drum open end while the other two could each extend one-eighth of that distance.

Figure 7:
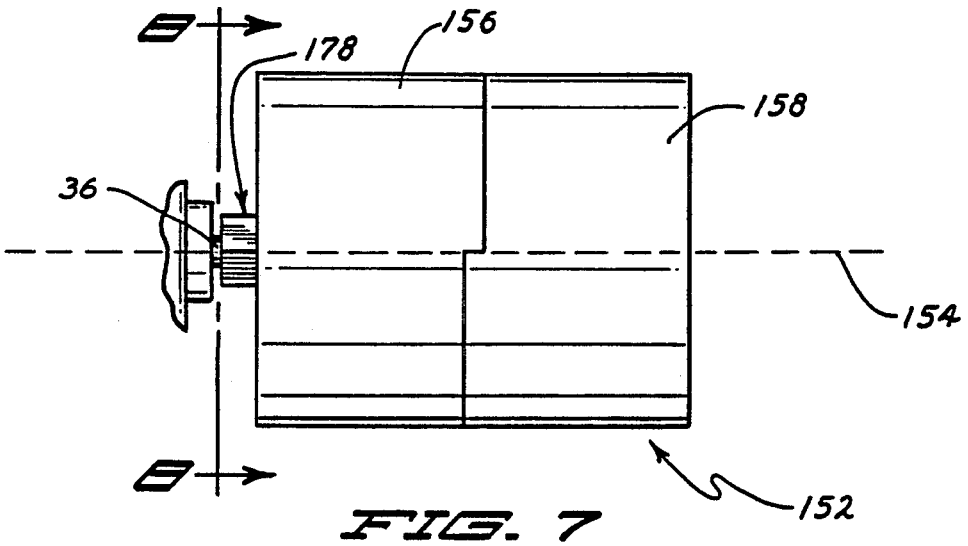
FIG. 7 shows another embodiment of a support means attached to the stub drive shaft of a portable power sweeping tool.
Figure 8:
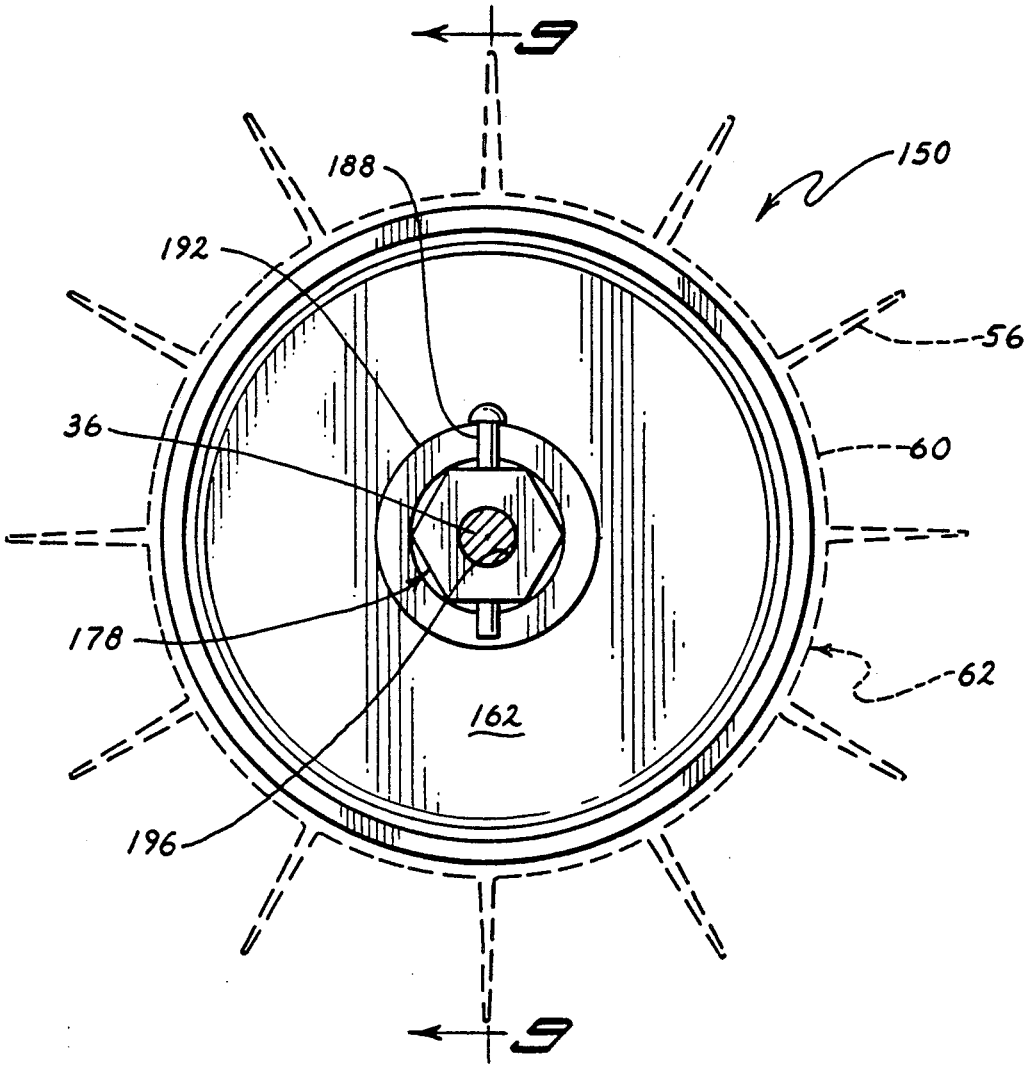
FIG. 8 shows an end view of the support means shown in FIG. 7 taken along viewing plane 8—8 thereof with the sweeper belt shown in phantom outline attached thereto.

When drums 156 and 158 are joined in an abutting end-to-end configuration as shown in FIG. 9, flanges 164 and 166 are disposed in an overlapping face-to-face engagement. In addition, the ends of the flanges **164*a* and 166*a* of drum 156 will abut the ends of the flanges 164*b* and 166*b*, respectively, of drum 158, thereby substantially preventing rotation of drums 156 and 158 with respect to each other about axis 154. This abutting relationship is best seen in FIG. 7 for the outer flanges 164 and in FIG. 9 for the inner flanges 166**.

The foregoing description of the abutting, mating ends of drums 156 and 158 provides an easily manufactured cylindrical support in that only one mold is needed to manufacture both drums, thereby reducing tool-up cost. Other known means for joining the drums 156 and 158 together, such as well-known male/female couplings or interdigitated teeth, for example, can also be used and are within the scope of the present invention. These other methods may require two molds, however, and will increase tool-up expenses.

Each end wall 162 substantially closes an end of drums 156 and 158 and each includes a noncircular aperture 176 substantially centrally disposed therein. Apertures 176 are preferably defined in part by an inwardly extending hub collar 177 (FIG. 9). Support means 152 further includes an axle 178 having an elongate axis substantially coincident with axis 154. Axle 178 is configured to be snugly received by the noncircular apertures 176 in end walls 162 of drums 156 and 158. The interaction of axle 178 with collars 177 helps rigidify support means 152. The apertures 176 and axle 178 each have noncircular configurations so as to prevent axle 178 from rotating within apertures 176. Other known nonrotation means may be utilized rather than the noncircular configuration, if desired. As shown, axle 178 has a substantially hexagonal configuration as do apertures 176.

Axle 178 includes first and second through holes 180 and 182 respectively disposed in first and second axle ends 184 and 186. Holes 180 and 182 each extend transversely to the elongate axis of axle 178. Axle 178 is of sufficient length such that, when it is inserted through apertures 176 and flanges 162 and 164 are placed in face-to-face engagement, through holes 180 and 182 will be disposed outside of end walls 162. That is, axle 178 is of sufficient length that opposite ends thereof project axially beyond the end walls of the mated drum members. Each hole 180, 182 is configured to receive a pin 188, 190, respectively that may be retained in place by known means such as a key inserted into a transverse through-hole in the end of the pin. If desired, spacers 192, which may be common washers of sufficient diameter to accept axle 178 therethrough, may be used to space pins 188 and 190 from contact with end walls 162. As shown, each end wall 162 is slightly recessed from the end of drum 156, 158. This provides a substantially annular volume 194, best seen in FIGS. 9 and 10 in which to dispose pins 188 and 190 out of running interference with the environment. Additionally, it is preferred that axle 178 is sized so that second end 186 of axle 178 not extend beyond the end of drum 158 for the same reason.

Referring to FIGS. 9 and 10 in particular, sweeper attachment 150 further includes means for mounting the sweeper attachment 150 to a stub drive shaft, such as stub drive shaft 36 as shown. Thus, axle 178 may include a longitudinal bore 196 disposed in an end of the axle 178. Bore 196 has an axis coincident with axis 154 and is configured to receive snugly a stub drive shaft 36 or 38. Through hole 180 intersects the stub drive shaft bore such that the through hole 180 can be aligned with the through hole 198 in the stub drive shaft. Thus, pin 188 can be inserted through through hole 180 in axle 178 and the aligned through hole 198 in the stub drive shaft to attach sweeper attachment means 150 to stub drive shaft 36 for synchronous rotation therewith. In other words, the mounting means comprises a hub formed by the collars 177 and first end 184 of axle 178, the hub having a stub drive shaft receiving bore 196 that snugly receives the stub drive shaft.

Thus, the use of drums 156 and 158, preferably formed from injection molding of synthetic materials, provides a readily assemblable, cost-effective way of manufacturing a sweeper attachment. Drums 156 and 158 will preferably be injection molded from polypropylene. Other plastic materials, such as nylons, could also be utilized. Cylindrical support means 152 is formed simply by mating drums 156 and 158 to each other such that flanges 162 and 164 are placed in face-to-face engagement. Axle 178 is then inserted through a washer 192 and through apertures 176. A pin 190 is inserted in second end 186 of axle 178. A second washer 192 is then inserted over first end 184 of axle 178 and stub drive shaft 36 is inserted within bore 196. Pin 188 can then be inserted through hole 180 of axle 178 and the hole 198 in the end of the stub drive shaft. As noted, keys or other known pin retention means may be used to retain pins 188 and 190 in position and to firmly affix the cylindrical support means 152 to the stub drive shaft. Belt 62 may then be attached around the cylindrical support means 152 in the manner previously discussed. The support means shown has a substantially cylindrical outer configuration, though other configurations also would come within the purview of the present invention. For example, the outer surface could have a faceted structure that would match a similarly faceted inner belt carcass surface. This matching faceted structure would help prevent rotation of the belt 62 with respect to support means 152.

The present invention having thus been described, other modifications, alterations, or substitutions may now suggest themselves to those skilled in the art, all of which are within the spirit and scope of the present invention. It is therefore intended that the present invention be limited only by the scope of the following claims.

What is claimed is:

1. A sweeper attachment for attachment to a portable tool that comprises an elongate boom, a power generation means disposed at one end of the boom, and a power transmission means extending between the power generation means and the other end of the boom for transmitting power generated by the power generation means to other end of the boom, the power transmission means including first and second stub drive shafts extending transversely to and outwardly from the other end of the boom in opposite directions and rotatable by said power generation means, wherein said sweeper attachment comprises:

a support means having a support means axis and a substantially symmetrical configuration about said axis, said support means including mated first and second substantially identical drum members, each said drum member defined by at least one side wall, an end of said side wall of each drum member including at least two flanges extending substantially parallel thereto such that said flanges mate in engagement with each other when said drum members are abutted end-to-end to form said support means;

means for removably retaining said drum members in mated engagement to form said support means;

means for mounting said support means to a said stub shaft such that said support means rotates synchronously with said stub drive shaft; and a sweeper belt attached around said support means for sweeping rotation therewith, said sweeper belt having a plurality of outwardly extending sweeper elements.

2. The sweeper attachment of claim 1 wherein:

said flanges on each drum member project axially from said end thereof and are formed alternately around said end on inner and outer wall positions of said one side wall of each drum member, whereby the flanges of one drum member overlap the mating flanges on the other drum member when the drum members are abutted end-to-end.

3. The sweeper attachment of claim 1 wherein:

each said drum member includes an end wall for substantially closing an end of said drum, each said end wall of each said drum member including an aperture substantially centrally disposed therein; and said means for removably retaining said drum members in mated engagement includes:

an axle having an elongate axis and configured to extend through said drum members and be received by said apertures of said end walls when said drum members are mated to each other.

4. The sweeper attachment of claim 3 wherein:

said axle includes first and second through holes extending transversely to said elongate axis and disposed in opposing ends thereof, said axle being of sufficient length such that said first and second ends thereof extend beyond said end walls of the mated drum members; and first and second pin means received snugly by said first and second through holes respectively such that said drum members are held closely engaged when said drum members are mated.

5. The sweeper attachment of claim 3 wherein:

said axle is of sufficient length that said first and second ends thereof project axially beyond said end walls of the mated drum members; and fastening means removably affixed to said first and second ends of said axle outside of said end walls for securing said axle and said drum members against relative axial displacement.

6. The sweeper attachment of claim 3 wherein:

one end of said axle includes a stub drive shaft bore configured to receive a stub drive shaft, said bore being disposed in said one end of said axle substantially parallel to said elongate axis, and further includes means for securing said one end of the axle to the stub drive shaft.

7. The sweeper attachment of claim 1 wherein:

said means for mounting said support means includes at least one end wall extending across said side wall of one of said drum members and further comprises receiving means on said end wall for connection of a stub drive shaft.

8. The sweeper attachment of claim 1 wherein one of said drum members includes an end wall and said mounting means comprises a hub having a stub shaft-receiving bore for snugly receiving a stub drive shaft, said hub being disposed on said end wall, said hub and the stub drive shaft each having a transverse hole therethrough, wherein said transverse hole of said hub is capable of being aligned with the transverse hole of the stub drive shaft when the stub drive shaft is received within said receiving bore, said sweeper attachment being retained relative to the drive shaft for synchronous rotation by a retaining pin inserted through the aligned through holes 9. The sweeper attachment of claim 1 wherein said sweeper elements comprise pliant fins that each have a substantially rectangular cross section and extend substantially parallel to said support means axis.

10. The sweeper attachment of claim 1 wherein said sweeper elements comprise pliant fins each of which includes inner segments extending laterally beyond said support means inwardly toward the boom so as to provide substantially continuous fins over the entire width of said sweeper attachment so that said sweeper attachment sweeps a continuous swath substantially equal to the width thereof.

11. The sweeper attachment of claim 10 wherein the length of said fin segments is substantially equal to or greater than the distance between the inner end of its respective support means and the center of the boom.

12. A hand held, readily portable power sweeping tool comprising:

an elongate boom;

power generation means disposed at one end of said boom;

sweeping means disposed at the other end of said boom; and power transmission means extending between said power generation means and said sweeping means for transmitting power generated by said power generation means to said sweeping means, said power transmission means including at least a first stub drive shaft extending substantially transversely to and outwardly from said boom;

wherein said sweeping means comprises:

at least a first sweeper, said sweeper including a cylindrical support means, said support means including a mounting means for affixing said sweeper to said drive shaft so that said sweeper rotates with said drive shaft, said sweeper further including a plurality of outwardly extending sweeping elements.

13. The tool of claim 12 and further including a sweeper belt attached around said cylindrical support means for rotation therewith, said sweeper belt including said plurality of outwardly extending sweeping elements.

14. The tool of claim 13 wherein said sweeping elements comprise pliant fins.

15. The tool of claim 12 wherein said sweeping elements comprise pliant fins.

16. The tool of claim 12 and further including a second stub drive shaft extending substantially transversely to and outwardly from said boom in a direction opposite to said first stub drive shaft, said sweeping means further comprising a second sweeper affixed to said second drive shaft for rotation therewith.

17. The tool of claim 16 wherein s id sweeping elements include pliant fins having inner segments extending laterally beyond said support means inwardly toward said boom so as to provide substantially continuous fins over the entire width of said sweeping means so that said tool sweeps a continuous swath substantially equal to the width of said sweeping means.

18. The tool of claim 16 wherein said stub drive shafts extend outwardly from and transversely to said boom along a common axis of rotation.

19. The tool of claim 12 wherein said mounting means comprises a hub having a shaft receiving bore for snugly receiving said stub drive shaft, said hub and said stub drive shaft each having a transverse hole therethrough said transverse holes being capable of being aligned when said drive shaft is received within said receiving bore, said sweeper being retained relative to said drive shaft for synchronous rotation by a retaining pin inserted through said aligned through holes.

20. A sweeper attachment for attachment to a portable tool that comprises an elongate boom, a power generation means disposed at one end of the boom, and a power transmission means extending between the power generation means and the other end of the boom for transmitting power generated by the power generation means to other end of the boom, the power transmission means including first and second stub drive shafts extending transversely to and outwardly from the other end of the boom in opposite directions and rotatable by said power generation means, wherein said sweeper attachment comprises:

a support means having a support means axis and a substantially symmetrical configuration about said axis, said support means including mated first and second substantially identical drum members, each said drum member defined by at least one side wall;

means for removably retaining said drum members in mated engagement to form said support means;

means for mounting said support means to a said stub shaft such that said support means rotates synchronously with said stub drive shaft; and a sweeper belt attached around said support means for sweeping rotation therewith, said sweeper belt having a plurality of outwardly extending sweeper elements.

21. A power sweeping tool for sweeping a surface comprising;

a power source;

an elongate cylindrical sweeping head having an exterior periphery surrounding a longitudinal axis;

a carrier, said sweeping head rotatably mounted to said carrier for rotation around the longitudinal axis;

transmission means for transmitting power from said power source to said sweeping head for rotatably driving said sweeping head relative to said carrier; and said sweeping head comprising a plurality of fins radially extending from said periphery and cooperatively arranged to extend substantially along the length of the sweeping head at multiple circumferential positions on said periphery, said fins being flexible whereby the fins flex when contacting the surface being swept.

22. A power sweeping tool as defined in claim 21 wherein the sweeping tool is a readily portable power sweeping tool adapted to be handheld by an operator, said carrier including an elongate boom having an end adapted for holding by the operator, said power sweeping tool being supported on the surface at least in part by the rotating flexible fins engaging the surface, said tool adapted to rotate said sweeping head in a direction to produce a sweeping action directed away from the operator.

* * * * *

UNITED STATES PATENT AND TRADEMARK OFFICE

CERTIFICATE OF CORRECTION

PATENT NO. : 5,269,082

DATED : December 14, 1993

INVENTOR(S) : Sund et al.

It is certified that error appears in the above-identified patent and that said Letters Patent is hereby corrected as shown below:

col 4, ln 14, delete "3" and insert -- 38 -- therefor.

col 4, ln 68, insert -- . -- after the word "material".

claim 17, col 10, ln 40, delete "s id" and insert -- said -- therefor.

Signed and Sealed this

Thirty-first Day of May, 1994

*Attest:*

Bruce Lehman

BRUCE LEHMAN

*Attesting Officer*

*Commissioner of Patents and Trademarks*